United States Patent [19]

Binstock et al.

[11] 4,226,086

[45] Oct. 7, 1980

[54] AUTOMATIC RESTART CONTROL FOR A POWER PLANT BOILER

[75] Inventors: Morton H. Binstock, Pittsburgh; Robert C. Lehmer, Shaler Township, Allegheny County; Steven J. Johnson, McCandless Township, Allegheny County; John J. Topolosky, Monroeville; Thomas E. Smith, Gibsonia, all of Pa.

[73] Assignee: Westinghouse Electric Corp., Pittsburgh, Pa.

[21] Appl. No.: 40,782

[22] Filed: May 21, 1979

[51] Int. Cl.[3] ..... F01K 13/02

[52] U.S. Cl. ..... 60/656; 60/646; 60/664

[58] Field of Search ..... 60/646, 656, 664

[56] References Cited

U.S. PATENT DOCUMENTS

| | | | |
|---|---|---|---|
| 2,900,792 | 8/1959 | Burl | 60/656 |
| 2,902,831 | 9/1959 | Ipsen | 60/656 |
| 3,226,932 | 1/1966 | Strohmeyer | 60/656 |
| 3,882,680 | 5/1975 | Durrant | 60/646 |
| 4,091,450 | 5/1978 | Bloch | 60/646 |

*Primary Examiner*—S. Clement Swisher

*Attorney, Agent, or Firm*—E. F. Possessky

[57] ABSTRACT

An automatic control is provided for fast restarts of a hot power plant. Boiler fuel demand is increased to reach a target load based on measured turbine metal temperature and throttle pressure. Fine tuning of the fuel demand is performed to achieve an actual match between the turbine and steam temperatures. Turbine bypass valves are operated during boiler firing the control steam pressure to a programmed pressure setpoint. Boiler firing rate is high limited by total boiler outlet steam to avoid flow overheating and bypass valve position is low limited in accordance with steam flow and throttle pressure to avoid excessively low steam flow. Reheater controls are operated to match intermediate turbine temperature and reheat steam temperature.

10 Claims, 6 Drawing Figures

AUTOMATIC RESTART CONTROL FOR A POWER PLANT BOILER

BACKGROUND OF THE INVENTION

The present invention relates to boiler controls and more particularly to automatic controls for restarting a hot boiler with temperature matching between the boiler and turbine.

Generally, a typical power plant while operating under load produces a steam temperature as high as 1000° F. The turbine temperature normally is slightly less with the exact temperature value dependent on the load and the resultant turbine valve throttling loss.

It is important that the turbine temperature not be changed too rapidly since rapid thermal changes stress the turbine and shorten its useful life.

A hot plant restart may occur right after an unplanned plant shutdown trip, or after an overnight or weekend shutdown. During a hot power plant restart, the turbine metal temperature is normally higher than that of the boiler steam because the boiler cools faster than the turbine. This is due both to the quicker cooldown rate of the boiler and the inability of the boiler to produce rated steam temperature at low load.

Conventional hot plant restart practice is to admit cooler steam gradually to the turbine until turbine metal and boiler steam temperatures are matched, and then gradually increase load. The load increase must also be gradual to avoid thermal turbine stresses due to increases in boiler steam temperature with increased load.

Power plants have historically been started this way since fast restarts have not been required. However, a need for faster hot plant restarts has been emerging, and specifications for new power plants now typically require temperature matching capability. With reduced national spinning reserve generating capacity and sharp regional load peaks, it is important that power plants be able to be restarted quickly when necessary. A plant tripped off line must, if there are no major problems, be able to be restarted quickly to assure adequate electrical supply. Further, with base loaded nuclear plants in operation, some fossil fueled power plants are shut down at night or during the weekends when the load drops and quick morning restarts are thus needed. Quicker hot plant restarts also consume less fuel and thus provide an energy conservation benefit.

To achieve a quick hot plant restart, some means is required to raise the boiler steam temperature to match that of the turbine. Unfortunately, the steam temperature is a function of both load and pressure in accordance with standard boiler characteristic curves. Perhaps the worst case example of this problem is a quick restart at full pressure after an accidental trip. The turbine is hot, say 980° F., but the steam temperature may be only 850° F. at low load.

Various boiler manufacturers have been responding to user demands and have been starting to implement various schemes to improve the low load temperature capability of the boiler. All techniques utilize bypass valving. However, little or no effort appears to have been directed to the development of automatic restart controls for the various kinds of bypass valve schemes being proposed.

SUMMARY OF THE INVENTION

A hot restart control is provided for a boiler in a power plant having a steam turbine with steam admission valve means for turbine steam flow and bypass valve means for bypass steam from the boiler to the plant condenser. The control includes means for generating a turbine metal temperature signal, means for generating a boiler steam temperature signal, and means for generating a boiler throttle pressure signal. Computer means are provided for generating a target boiler load and pressure in response to the turbine metal temperature and throttle pressure. The boiler combustion is controlled to increase the boiler firing rate after a boiler shutdown with the turbine admission valve means closed so as to increase the boiler steam pressure and temperature with continuously adequate boiler steam flow. Means are provided for operating the bypass valve means to control the steam throttle pressure to a pressure setpoint based on the target pressure with the turbine admission valves remaining closed. When the boiler steam and turbine temperatures are matched, the boiler firing rate is held. The opening movement of the turbine admission valves is then controlled to transfer steam flow to the turbine from the bypass valve means so as to accelerate, synchronize and load the turbine as the bypass valve operating means provides steam throttle pressure control with closing bypass valve movement.

DESCRIPTION OF THE PREFERRED EMBODIMENTS

Figure 1:
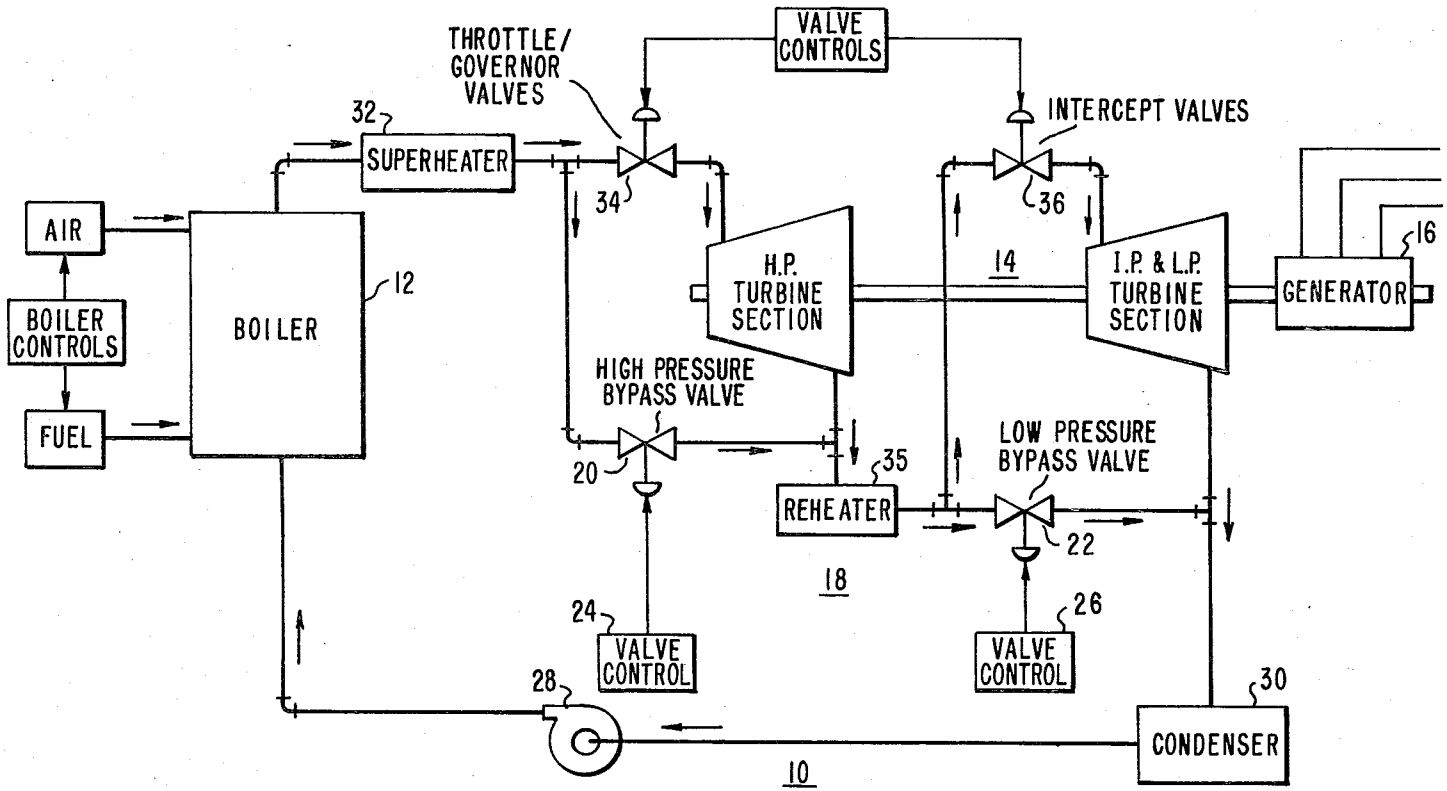
FIG. 1 shows a schematic diagram of a power plant controlled in accordance with the principles of the invention.
Figure 4:
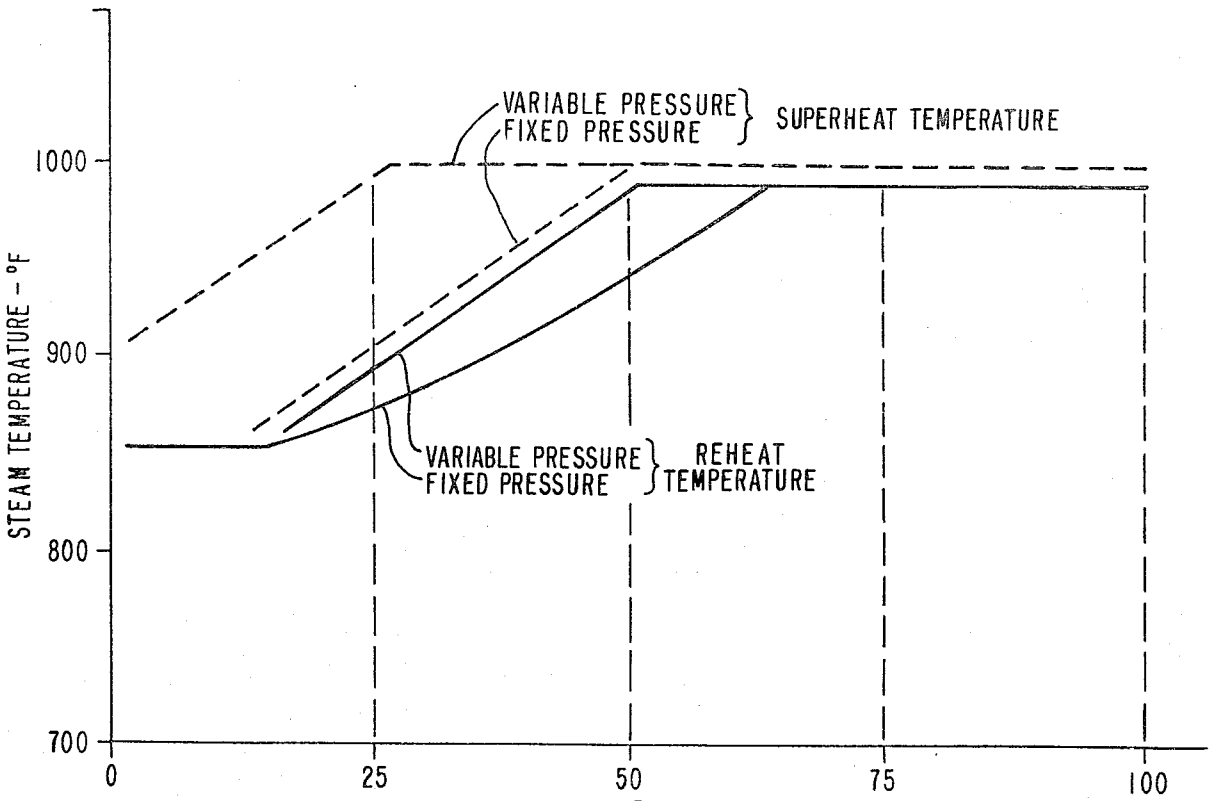
FIG. 4 shows a typical boiler load-temperature characteristic.

More particularly, there is shown in FIG. 1 an electric power plant 10 having a boiler 12 which supplies steam to drive a turbine 14 and electric generator 16. A turbine bypass valve system 18 is in this example shown to be the classical European type. It includes a high pressure bypass valve 20 and a low pressure bypass valve 22 which are automatically operated by controls 24 and 26 in accordance with the invention. Fast plant restart is enabled by the bypass system from its ability to produce an apparent boiler load and/or a reduced operating pressure. For example, as shown in FIG. 4 a boiler operating at 80% load would produce 1,000° F. superheat steam and perhaps a turbine temperature of 980° F. The load drops to zero if a plant trip occurs. It is desirable to bring the boiler unit on a hot restart back up to 80% load as quickly as possible. There is no turbine heating problem since the turbine is already at a high load operating temperature of 980° F. The boiler heating problem results from the inability of a standard boiler to produce 1,000° F. steam during the low load start-up procedure.

During conventional boiler operation, a feedpump 28 transfers water from a condenser 30 to the boiler 12 where fuel is burned to convert the water to steam. A superheater 32 heats the steam and controls its outlet temperature to 1,000° F. whenever possible. Turbine throttle/governor valves 34 are controlled to regulate the amount of steam flow into the high pressure turbine section which extracts useful work from the steam. The high pressure turbine exhaust steam is reheated by reheater 35 to 1,000° F. if possible, and the reheated steam passes through a turbine intercept valve 36 (normally open except during turbine start-up), through the turbine intermediate and low pressure sections which extract additional useful work from the steam and then back to the condenser 30 to start the cycle again.

To achieve fast hot restart capabilities, the bypass valves 20 and 22 are operated to produce turbine/boiler temperature matching prior to turbine startup. The plant operator uses controls to provide prior art bypass valve operation for a hot restart as follows:

(1) The operator reads the turbine metal temperature.

(2) From a boiler characteristic like that shown in FIG. 4, the required boiler load and pressure are determined.

(3) Fuel is applied to the boiler 12 to achieve the load.

(4) The boiler 12 is loaded and steam flows through the normal boiler circuits, the superheater 32, and the reheater 35, but the turbine valves 34 and 36 are closed so that boiler steam flows to the condenser 30, through the bypass valves 20 and 22 and not through the turbine 14. The boiler 12 therefore acts as though it is operating a turbine under load and produces the required superheat and reheat steam temperatures. Steam pressure is controlled during boiler restart by interaction of the boiler firing rate and the position of the bypass valve 20.

(5) After boiler/turbine temperatures are matched, the operator rolls the turbine by initiating the turbine start-up control which slowly opens the turbine valves 34 and 36 and at the same time the bypass valves 20 and 22 are closed. Ultimately, the bypass valves are fully closed and all boiler steam is diverted from the bypass system 18 and passes through the turbine 14 as in a conventional plant.

The present invention includes features which automate and improve the operation of a hot restart bypass system. Basically, the plant controls function in accordance with the invention to provide bypass valve system operation during a hot plant restart as follows:

(1) The operator selects automatic temperature matching.

(2) Signals representing the turbine metal temperature and the boiler throttle pressure are applied to the controls.

(3) The best pressure and load combination is computed using measured data and the boiler characteristic curve to allow a temperature match. The computed pressure and load values are preferably used as a target rather than an absolute value, and the target is adaptively modified as actual plant conditions change.

(4) Fuel is controllably added to the boiler since too high a fuel input without adequate steam flow overheats the superheater and the reheater. The bypass valves are controlled to control steam pressure. As steam pressure increases, steam flow increases and additional fuel can be added as the superheater and reheaters are somewhat protected. In turn, fuel can be increased even more and the process continues under automatic control until the computed target values of load, pressure and temperature are reached.

(5) Because of imperfections in measurements and day-to-day variations in either fuel BTU content or condition of the boiler, it is most probable that the target boiler steam temperature will be close to that of the turbine, but not actually matched to it unless further control action is taken. The present invention preferably further includes adaptive controls which determine when the target load is reached and then readjusts the fuel through a fine tuning mechanism to shift the load in the correct direction and assure a temperature match.

(6) A temperature match light is provided as an indicator for the operator.

(7) The turbine is then rolled, synchronized, and brought to load in the conventional fashion, either by the operator manually or by the turbine control system. This action results in the gradual opening of the turbine valves 34 and 36.

(8) As the turbine valves are opened, the bypass valves are automatically closed in a synchronized manner. For every additional unit of steam flow to the turbine 14, one less unit of steam goes through the bypass system. In other words, steam flow is smoothly diverted from the bypass system to the turbine 14.

In summary of the basic invention provisions, the operator is relieved of the requirement to operate the plant during a hot plant restart by means of an automatic control which provides needed control functions during restart operation. Thus, the boiler parameters needed to match turbine and boiler temperatures are computed, the boiler is fired to achieve a steam temperature which matches the turbine temperature. The steam pressure is regulated and the boiler is protected from overfiring during the temperature matching restart. Finally, the superheater and reheater steam temperatures are regulated and the proper boiler load is maintained by pressure regulation after a temperature match and as the turbine is being accelerated to synchronism and loaded.

AUTOMATIC RESTART CONTROL

Figure 2:
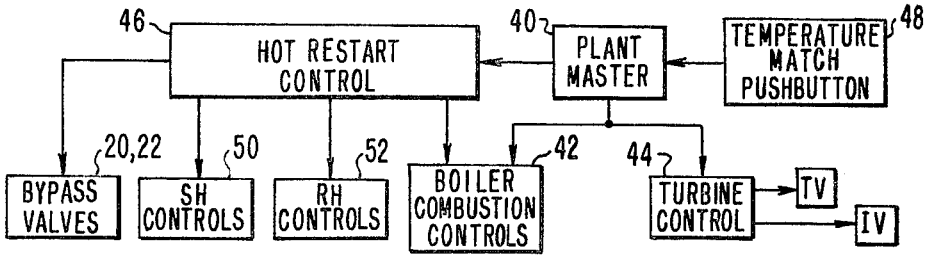
FIG. 2 shows a more detailed diagram of the way in which hot restart control is provided for the power plant.

As shown in FIG. 2, the power plant 10 is controlled by a plant unit master 40 which coordinates the operation of boiler combustion controls 42 and a turbine control 44.

A hot restart control 46 is initiated when the operator presses a Temperature Match Pushbutton 48 for a hot restart. Thereafter, the control 46 operates the bypass valves 20 and 22, superheater and reheater controls 50, 52 and the boiler combustion controls 42. The restart control 46 is described herein as being embodied with analog hardware, but other variations can be employed including digital computer implementations. Individual analog functional blocks are embodied with the use of conventional commercially available control circuit cards.

Figure 3A:
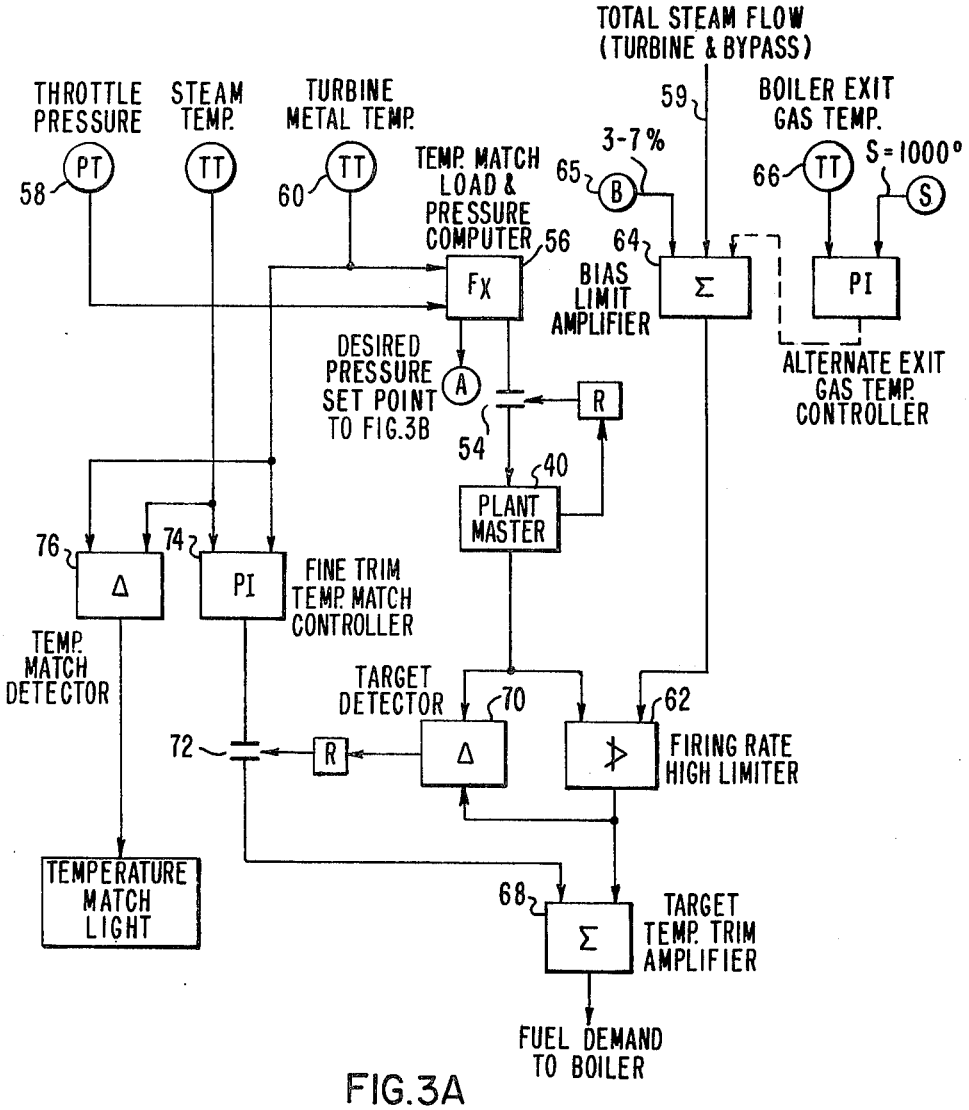
FIGS. 3A–3C show detailed functional diagrams of the hot start control.

As shown in greater detail in FIG. 3A, boiler load control during a hot restart is initiated by closure of relay contact 54 which then couples a target computer 56 to plant unit master 40.

The load and pressure computer 56 receives a throttle pressure signal 58 and a turbine metal temperature signal 60 and provides an output for the required target boiler load. To prevent process interaction, the output from the computer 56 becomes fixed when the contact 54 selecting a temperature match is closed. The computer 56 contains in its memory a temperature vs. load relationship like that shown in FIG. 4. The exact curve relationship is determined for each boiler based either on manufacturer's information or empirical measurements.

As an illustration of computer usage of the boiler curve in FIG. 4, if the measured boiler pressure is close to rated and the turbine temperature is 950°, a target boiler load of 37.5% is selected. To achieve 37.5% load, 37.5% fuel is required. Therefore, the computer 56 outputs a demand of 37.5% fuel to the plant unit master 40.

A firing rate high limiter 62 limits the 37.5% demand from the plant unit master 40 and the computer 56 to a safe warm-up value of 3–7% in response to a limit amplifier 64 having a bias input 65. Additional fuel is supplied to the boiler 12 as steam flow is established since a steam flow signal 59 is applied to the amplifier 64 causing the fuel demand limit to be raised as steam flow increases. As an alternate, hot boiler gas exit temperature 66, if available, can be used to limit the boiler firing.

The firing rate limiter 62 plays an important role due to its process adaptiveness. To prevent damage to the boiler piping, it is imperative that the boiler not be fired too much when there is inadequate steam flow. On the other hand, to achieve a quick restart it is important to fire the boiler as hard as possible. The firing rate limiter allows maximum firing with boiler protection by making use of relevant process feedback.

Target load is achieved when the 37.5% target is applied to and implemented by amplifier 68 as boiler fuel demand. As previously described, the target load value may not produce either an exact match between turbine metal temperature and boiler steam or even the actual target loading since, for example, the fuel BTU may have changed since initial control system calibration. It is thus preferred that means be provided to fine tune the boiler load to achieve a true temperature match.

Target detector 70 determines when the target load value is established, i.e. the input and output values of the firing rate limiter 62 are equal. The target detector 70 closes relay contact 72 to activate a fine trim temperature match controller 74. The actual steam temperature and turbine metal temperature are compared by the controller 74 and the resultant output signal acts through a target temperature trim amplifier 68 to fine trim fuel demand to the boiler 12 so as to adjust the load. Load changes, as shown in FIG. 4, in turn change the steam temperature to obtain a true match with the turbine metal temperature.

A temperature match detector 76 compares the two temperature signals and provides the operator with a temperature match light signal when the turbine metal and steam temperatures are equal. The operator is then free to roll and load the turbine.

Figure 3C:
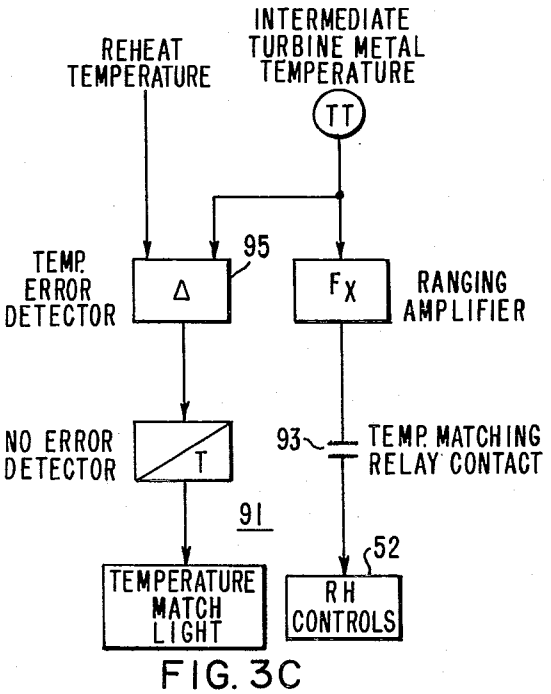
Figure 3B:
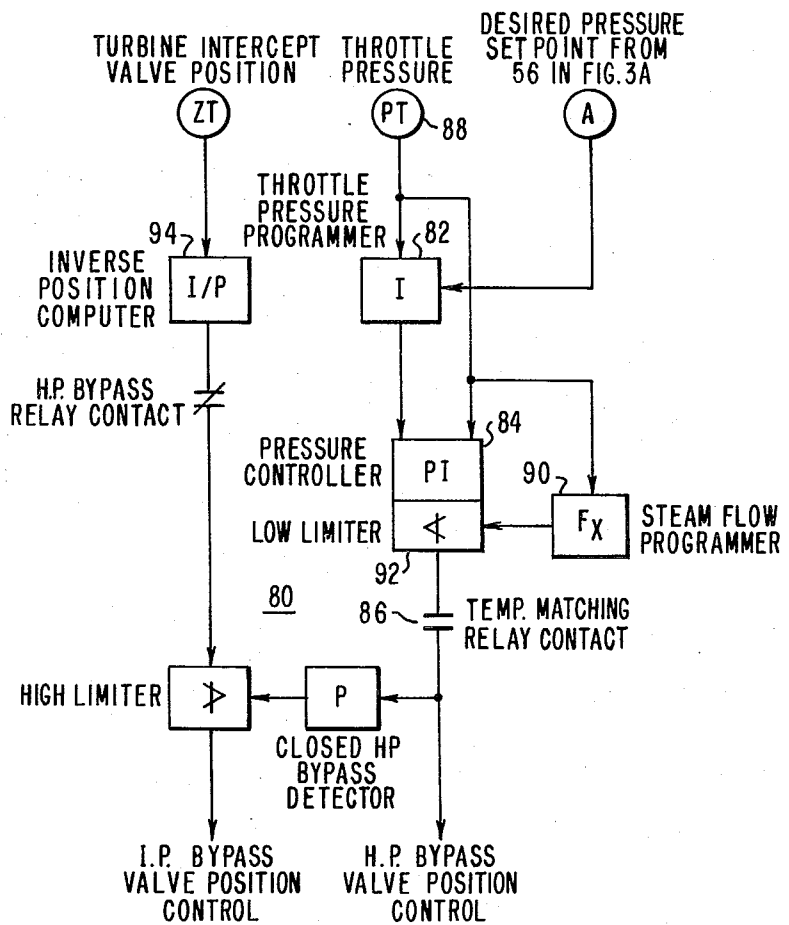

In FIG. 3B, there is shown a pressure control portion 80 of the hot restart control. When the operator selects automatic temperature matching, the computer 56 uses information on the plant current status and the FIG. 4 curve to select a target load as previously described. In addition a pressure setpoint which should allow a temperature match at the target load is selected by the computer 56. As described, the load is controlled by regulating the amount of fuel supplied to the boiler. However, unlike a conventional boiler, the boiler outlet pressure is controlled by a valve, specifically the high pressure bypass valve 20. This control strategy allows control decoupling between load and pressure and also allows for a decoupled or noninteractive pressure control when load is transferred from the bypass system 18 to the turbine 14.

Once the operator selects temperature matching and the target pressure is established, the pressure control portion 80 begins to function and a throttle pressure programmer 82 gradually ramps the throttle pressure setpoint from the current value to the required value. A pressure controller 84, acting through a closed relay contact 86, compares the pressure setpoint against the actual pressure from sensor 88 and regulates the position of the high pressure bypass valve 20 through a conventional valve positioner. Too low a pressure results in closing valve movement.

Steam flow programmer 90 and low limiter 92 respond to a throttle pressured signal to limit bypass valve movement and protect the boiler 12 from too low a steam flow. It is important, as previously described, that adequate steam flow be maintained to prevent overheating the boiler 12. When the steam throttle pressure is less than the setpoint valvue, it is possible for the pressure controller 84 to close the high pressure bypass valves too much in an attempt to raise pressure and thereby cause a severe loss in steam flow. The steam flow programmer is characterized to generate a safe limit on bypass valve position as a function of throttle pressure. Thus, the low limiter allows the controller to close the valve somewhat, i.e. enough to cause a gradual pressure buildup, but not so much as to cause an unnecessary faster pressure buildup while jeopardizing steam flow.

After the temperature is matched, the pressure controller 84 assures a smooth transfer of load from the bypass system 18 to the turbine 14. The load transfer is decoupled from the boiler load control.

Since boiler firing is steady, total load remains constant. Opening of the turbine valves results in a short term load increase. As the energy into the boiler is not increased, the additional load starts to use up the boiler stored energy and therefore starts to cause a throttle pressure drop. The pressure controller 84 senses the drop and smoothly closes the high pressure bypass valve to restore the pressure. In actual operation, as the turbine valves open, the high pressure bypass valve closes in an equal amount, thereby causing smooth transfer of steam from the bypass system 18 to the turbine 14.

To maintain flow balance in the bypass system 18, the IP bypass valve is inversely slaved to the turbine IP intercept valve by inverse position computer 94 and closes as the turbine IV valve opens. The governor and intercept valves are coupled together so that opening the governor valve also opens the intercept valve. The IP bypass valve is controlled to close in proportion to the IV valve opening thereby to maintain total boiler load resistance constant and thereby to assure a controlled steam flow transfer from the condenser to the IP turbine. Any error in total boiler load resistance results in a throttle pressure error which is compensated by the HP bypass pressure control. With system decoupling, the turbine controls are free to regulate speed or load without regard to throttle pressure control.

FIG. 3C shows a control 91 used to match reheat temperature to intermediate pressure temperature. Measured intermediate pressure metal temperature is the setpoint for reheat temperature. The setpoint is wired through a relay contact 93 to the boiler control which controls reheat temperature to the new setpoint through existing controls such as tilts, sprays, pass dampers, etc. A light is operated by a temperature error detector 95 when the reheat temperature matches the turbine metal temperature.

Control of reheat temperature is in accordance with the controls in FIG. 3C. Depending on which loop (superheat or reheat) increases temperature faster, the roles of the superheater and the reheater may be switched.

With reference to FIG. 3A, the high pressure turbine metal temperature and superheat temperature become the intermediate pressure turbine metal temperature and reheat temperature on a sole reversal. All other functions and operation are the same. In this case, the controls of FIG. 3C would then control HP turbine metal temperature to superheat temperature.

What is claimed is:

1. A hot restart control for a power plant having a boiler and a steam turbine with steam admission valve means for turbine steam flow and bypass valve means for bypass steam from the boiler to the plant condenser, said control comprising means for generating a turbine metal temperature signal, means for generating a boiler steam temperature signal, means for generating a boiler throttle pressure signal, computer means for generating a target boiler load and pressure for a turbine and steam temperature match in response to the turbine metal temperature and throttle pressure, means for controlling the boiler combustion to increase the boiler firing rate after a boiler shutdown with the turbine admission valve means closed so as to increase the boiler steam pressure and temperature with continuously adequate boiler steam flow, means for operating said bypass valve means to control the steam throttle pressure to a pressure setpoint based on the target pressure with the turbine admission valves remaining closed, means for detecting when boiler steam and turbine temperature match conditions exist and for holding said combustion controlling means when such match conditions are achieved, and means for controlling the opening movement of the turbine admission valves to transfer steam flow to the turbine from said bypass valve means so as to accelerate, synchronize and load the turbine as said bypass valve operating means provides steam throttle pressure control with closing bypass valve movement.

2. A hot restart control as set forth in claim 1 wherein said combustion controlling means includes means for generating a fuel demand which increases with time until the target load is reached.

3. A hot restart control as set forth in claim 2 wherein said fuel demand generating means includes a high limiter which limits the fuel demand as a function of the boiler outlet steam flow.

4. A hot restart control as set forth in claim 2 wherein said fuel demand generating means includes a high limiter which limits the fuel demand as a function of the boiler exit gas temperature.

5. A hot restart control as set forth in claim 2 wherein said combustion controlling means further includes means for detecting when the boiler reaches the target load, means are provided for responding to the turbine and steam temperatures to modify adaptively the boiler fuel demand to achieve an actual temperature match.

6. A hot restart control as set forth in claim 1 wherein said bypass valve operatng means includes programmer means for generating an increasing throttle pressure setpoint as a function of the actual throttle pressure and the target pressure, and controller means are provided for generating a bypass valve position signal in response to the programmer pressure setpoint.

7. A hot restart control as set forth in claim 6 wherein means are provided for low limiting the bypass valve position as a function of the throttle pressure.

8. A hot restart control as set forth in claim 6 wherein the turbine is provided with high pressure and intermediate pressure sections and throttle/governor valve means and intercept valve means respectively therefor, the bypass valve means includes high pressure bypass valve means and intermediate pressure bypass valve means, and wherein means are provided for responding to intercept valve position to generate a position signal for the intermediate bypass valve means inversely to the intercept valve position.

9. A hot restart control as set forth in claim 5 wherein said bypass valve operating means includes programmer means for generating an increasing throttle pressure setpoint as a function of the actual throttle pressure and the target pressure, and controller means are provided for generating a bypass valve position signal in response to the programmer pressure setpoint.

10. A hot restart control as set forth in claim 1 wherein the turbine includes high and intermediate pressure turbine sections, the boiler includes a reheater with steam temperature controls therefor, and means are provided for detecting intermediate turbine temperature and for operating the reheater steam temperature controls to achieve a temperature match between reheat steam and the intermediate pressure turbine section.

* * * * *